United States Patent [19]

Zola et al.

[11] Patent Number: 4,501,305

[45] Date of Patent: Feb. 26, 1985

[54] RECEPTACLE FOR COLLECTION OF FUEL SPILLS

[76] Inventors: J. Richard Zola, 35 Lora Stirling Dr., Morristown, N.J. 07960; Stanley W. Prenosil, 920 Lynndale, Rochester, Mich. 48063

[21] Appl. No.: 504,993

[22] Filed: Jun. 16, 1983

[51] Int. Cl.[3] ..... B65B 1/04

[52] U.S. Cl. ..... 141/86; 383/72; 222/108; 141/392

[58] Field of Search ..... 141/1, 84–88, 141/89, 93, 97, 110–112, 390–392; 222/108, 189; 150/55; 383/71, 72, 75, 77, 38, 61, 102; 53/409, 204; 137/377, 381; 422/900

[56] References Cited

U.S. PATENT DOCUMENTS 3,789,897 2/1974 Saito ..... 383/75

4,069,852 1/1978 Lofberg ..... 383/71

FOREIGN PATENT DOCUMENTS 619078 3/1961 Italy ..... 383/72

*Primary Examiner*—Stephen Marcus

*Assistant Examiner*—Ernest G. Cusick

*Attorney, Agent, or Firm*—Sughrue, Mion, Zinn, Macpeak, and Seas

[57] ABSTRACT

A receptacle for collecting gasoline fuel spills is provided having an outer flexible wall and a bottom pervious wall. The outer flexible wall is provided with a tie string in the neck thereof whereby the receptacle may be sealed by pulling the tie string together. A central aperture is provided in the bottom pervious wall. Secured within the central aperture is a central flexible wall having an upper and extending above an upper end of the receptacle. The upper end of the tubular central wall has a tie string therein for securing the neck of the tubular inner wall against a fill pipe of a gasoline underground tank. The receptacle contains layers of absorbent material for absorbing gasoline which may spill out of the fill pipe during filling of the underground tank. When the absorbent materials absorb sufficient gasoline, the receptacle may be removed from about the fill pipe and the drawing strings pulled together to contain the absorbed gasoline within the receptacle.

11 Claims, 5 Drawing Figures

FIG. 1
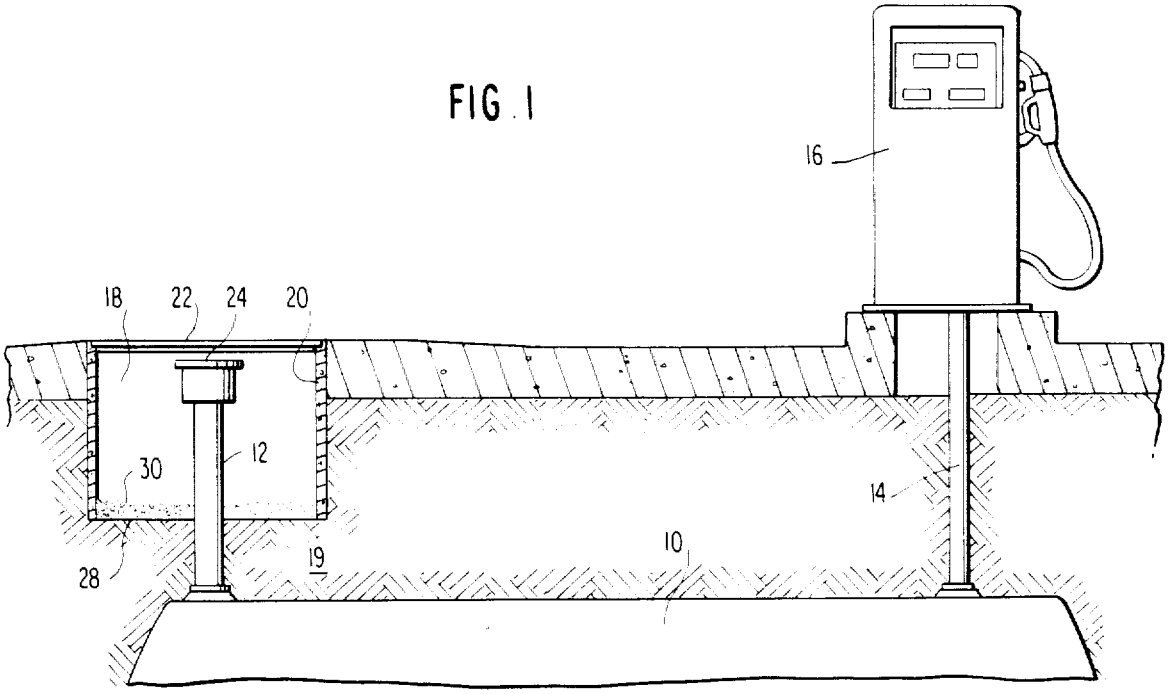
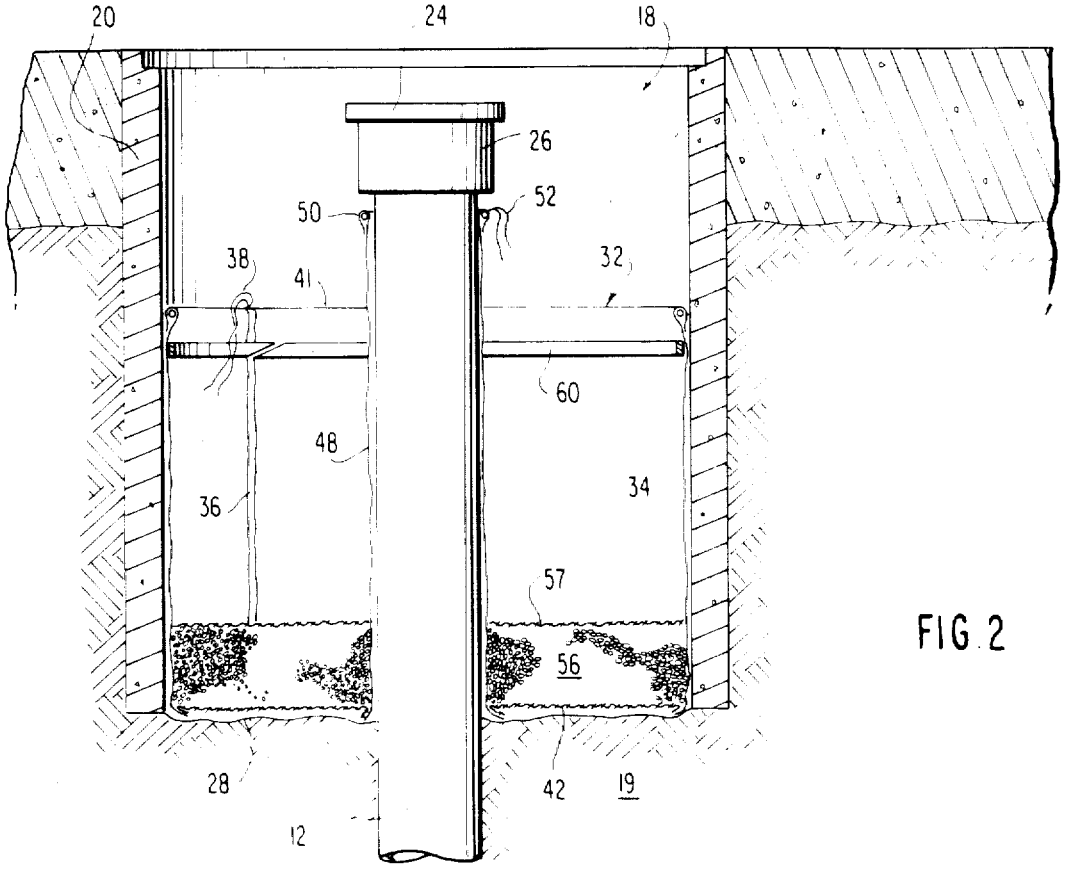
FIG. 2

RECEPTACLE FOR COLLECTION OF FUEL SPILLS

BACKGROUND OF THE INVENTION

1. Field of the Invention

This invention pertains to a receptacle for collecting and retaining leaks or other unwanted discharges of fluids, especially fluids which are toxic or otherwise adversely effect the environment.

2. Statement of the Prior Art

As an example of a situation in which the invention is an improvement over the prior art, it is conventional for the fill pipe of an underground liquid gasoline tank to be contained within a well having a removable cover. During filling of the underground gasoline tank from a tanker or the like, it often occurs that gasoline spills out of the fill pipe or tanker hose into the well. It is important to collect or absorb the spilled gasoline in the well before it leaks into the ground and finds its way into the water table below. Various gasoline absorbing chemicals have been used for this purpose. However, it becomes tedious and difficult to remove the chemical absorbents when they have absorbed spilled gasoline or other materials.

An object of this invention, therefore, is to provide an efficient means for collecting and absorbing spilled materials and disposing of these materials once they have been absorbed.

SUMMARY OF THE INVENTION

This invention is concerned with providing a portable, lightweight and inexpensive receptacle for collecting spilled liquids such as gasoline, petrochemicals, transportation fluids, chlorinated solvents or aromatic solvents.

It is one object of this invention to provide a portable receptacle which has a flexible outer wall adapted to conform to a surrounding structure, such as, for example, the well housing of the fill pipe for an underground storage tank for gasoline or other toxic, hazardous or otherwise environmentally undesirable material.

The receptacle has a bottom wall pervious to the passage of water, such as, rain water, which may enter the well. The receptacle also includes an inner tubular wall extending through a central aperture in the bottom wall. The inner tubular wall is adapted to conform to or telescope over a fill pipe or the like. Draw strings or other closure means for the outer and inner wall may be provided whereby, after use, the outer and inner wall may be pulled together or otherwise secured in closed fashion thus substantially sealing the receptacle.

BRIEF DESCRIPTION OF THE DRAWINGS

FIG. 1 is a cutaway view of a gasoline pumping system showing a gasoline pump, underground gasoline tank, fill pipe within a well and gasoline absorbent in the bottom of the well to absorb spilled gasoline.

FIG. 2 is a cutaway view similar to FIG. 1 showing the receptacle of this invention installed within the well and about the fill pipe.

DESCRIPTION OF THE PREFERRED EMBODIMENT

Figure 3:
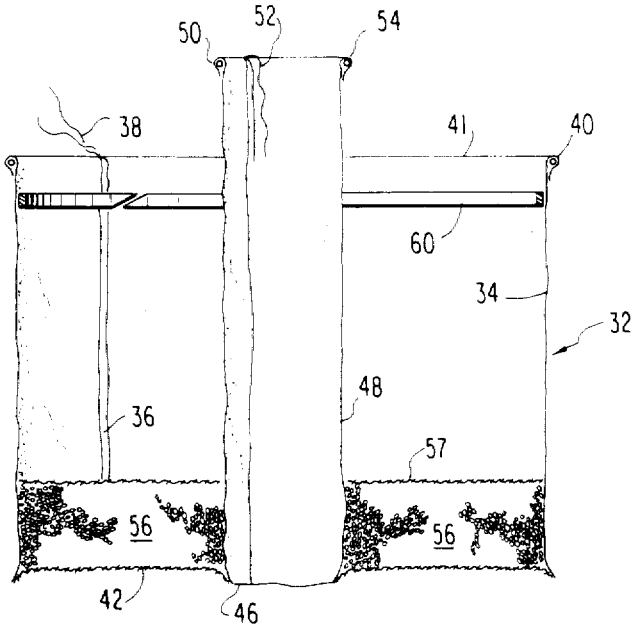
FIG. 3 is a cutaway view of the receptacle showing outer wall, inner wall and tie strings on said walls for closing the walls in sealed condition.

Referring in more detail to the drawings, FIG. 1 is a cutaway or side view of a gasoline storage and pumping system. In this system, 10 is an underground storage tank for gasoline, 12 is a fill pipe, 14 is the dispensing pipe and 16 is the dispensing pump. The fill pipe 12 extends into a well 18 having side walls 20 which are usually cylindrical in form. A cover plate 22 of suitable material may be used to close the well 18. The fill pipe 12 has a cap 24 to close the upper end 26. The bottom 28 of the well 18 is comprised of earth 19 and is covered with gasoline-absorbing beads 30. While the beads are absorbent for gasoline, they are non-absorbent to water which passes through the beads and is absorbed into the earth 19.

While filling the gasoline tank 10 through fill pipe 12, it often occurs that some gasoline overflows into the well 18 where it is absorbed by the beads 30. The beads 30, however, tend to expand and set-up whereupon there removal from the well is difficult. In removal and disposal of the mass of contaminated beads further pollution of the area also often occurs.

The present invention provides an efficient, low cost solution to the collection of spilled fluids, such as, gasoline and disposal thereof.

To this end, FIG. 3 shows a receptacle 32 having flexible vertical and continuous outer wall 34 which, if sewn from a fabric, will have a seam 36 therein. The wall 34 may have closure means such as tie string 38 in a hollow bead 10 at the upper open end or neck 41. The neck 41 is maintained open during use. The receptacle 32 has a substantially horizontal bottom wall 42 of water permeable material. The periphery of the bottom wall is sewn or joined through its periphery to the lower periphery of the side wall. The bottom wall 42 has a central aperture or opening 46. A tubular inner substantially vertical wall 48 is secured within the central opening 46 by stitching or other sealing means. Tubular wall 48 is flexible and extends above the bead 40 of open neck 41 of the outer wall. The upper open end or neck 50 of the tubular wall 48 has a draw string 52 contained within a hollow bead 54. The bottom of the receptacle has layers of absorbent beads 56 to absorb spilled gasoline.

Figure 4:
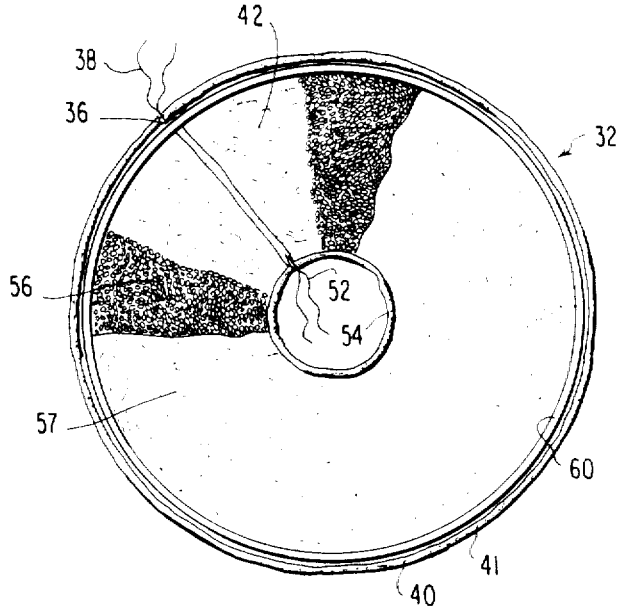
FIG. 4 is a top view of the receptacle showing the outer wall and draw string, inner wall and draw string and absorbent beads on the bottom wall.

FIG. 4 is a top view of the receptacle showing the outer wall 36, draw string 38, inner wall 48, draw string 52, central aperture 46, and absorbent material 56.

In operation, as seen in FIG. 2, the receptacle 32 is inserted into well 18 with inner tubular wall 48 telescoped over the fill pipe 12. The draw string 52 is pulled tight about the fill pipe 12 below the enlarged portion 26 to seal the tubular wall neck 41 to the fill pipe 12 or other aperture through which fluids are discharged into a container for said fluids. The outer flexible wall 35 conforms to the wall 20 of the well 18. The bottom 42 of the receptacle 32 rests on the earth floor 28. Bottom 42, as previously mentioned, is permeable to water which leaks therethrough into the earth 19 and is absorbed thereby.

The bottom of the receptacle 32 is filled with a layer of gasoline absorbent beads 56. The beads 56 may optionally be covered with a hold down pad 57 of fabric or other material which permits water to pass through the receptacle and permits the spilled liquid to reach the absorbent beads. Thus positioned in the well 18, the receptacle 32 will catch any gasoline or other toxic material spilling out of the fill pipe 12 during filling of the tank 10. The absorbent beads 56 absorb the spilled gasoline thus preventing the spilled gasoline from penetrating into the earth 19 through the pervious bottom wall 42 of the receptacle 32. On the other hand, water which may enter the well 18 from time to time passes through the beads 56, the pervious bottom wall 42 and into the earth 19.

Figure 5:
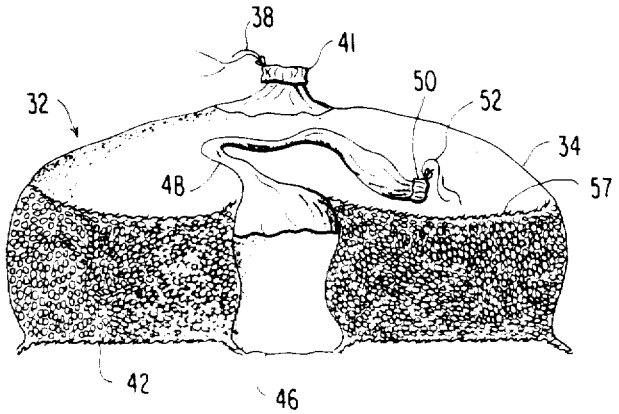
FIG. 5 is a side view of the receptacle closed at the necks of the inner wall and outer wall, in this condition, the receptacle is ready for disposal.

When the beads 56 have become saturated with spilled gasoline, the receptacle 32 is removed from the fill pipe 12 and the well 18 for disposal, FIG. 5. In this regard, the pull string 52 of tubular wall 48 is pulled tight sealing the end 50. The sealed tubular wall 48 is then folded into the receptacle 32 and the tie string 38 pulled tight pulling the neck 41 of the receptacle together thus sealing the contents of the receptacle inside. The sealed receptacle may then be disposed and a new one replaced in the well.

To aid erection of the receptacle in the well a spring collar 60 such as, for example, a flexible plastic polypropylene spring which may be inserted in the neck of the device as shown in FIGS. 2, 3 and 4.

Suitable material for the absorbent beads will be well known to those of skill in the art and include, e.g., polymeric absorbent beads such as those sold as EMCO IMBIBER BEADS. The beads 56 may also be mixed with other natural material such as sand. Suitable material for the body of the receptacle will likewise be well known to those of skill in the art; the preferred material with which we have worked is a woven coated polyethylene e.g., an 8 by 8, 8 by 9 or 12 by 12 woven pattern of extruded and slit strips of polyethylene then coated with liquid polyethylene 1.25 mil thick on both sides to water and air proof the structure. Additives may be incorporated in the plastic to improve UV resistance. The bottom of the receptacle may be of a variety of water permeable porous substances which are resistant to the spilled liquid to be collected on the absorbent beads. In the case of spilled gasoline a non-woven sheet of polyester filter material may comprise the bottom element.

While the invention has been shown and described in detail with reference to a preferred embodiment thereof, it will be understood to those skilled in the art to which this invention pertains, that various changes in the form and detail may be made therein without departing from the spirit and scope of the invention.

What is claimed is:

1. A receptacle for collecting fluids spilled during discharge of said fluids into a fill pipe or other opening through which filling of a container or liquid passage is to be effected comprising:

a substantially vertical, continuous, outer side wall of flexible material impervious to said fluid, the upper periphery of said wall forming an open neck when said receptacle is disposed to collect said fluids;

a water permeable substantially horizontal bottom wall having a central aperture, the periphery of said bottom wall being joined throughout its periphery to the lower periphery of said side wall;

an inner substantially vertical wall joined at its lower end to said aperture and a neck at the opposite upper end, said neck being adapted to surround the neck of a fill pipe or other aperture through which fluids are discharged into a container for said fluids; and a layer of absorbent material on said bottom wall adapted to absorb said fluid.

2. A receptacle for collecting fluids as defined in claim 1, further comprising:

means to close the necks of said inner and outer walls after said receptacle has been used.

3. A receptacle as defined in claim 1, wherein:

said outer wall is formed of a flexible material impervious to said fluid and adapted to conform to a wall of a well in which said receptacle is deployed.

4. A receptacle as defined in claim 1, wherein:

said inner substantially vertical wall is formed of a flexible material impervious to said fluid and adapted to conform to the outer shape of said fill pipe or other opening.

5. A receptacle as defined in claim 1, wherein:

said absorbent material comprises beads of absorbent material.

6. A receptacle as defined in claim 1, wherein:

said layer of absorbent material covered with a fabric pad.

7. A receptacle as defined in claim 1, and:

a spring collar in said neck to maintain the neck open.

8. In combination with a gasoline tank fill pipe and spill well, the improvement comprising:

a receptacle having an outer wall conforming to the walls of the spill well;

said outer wall having a neck;

a bottom wall having a central aperture, the bottom wall resting on the bottom of spill well;

an inner wall having one end secured within the aperture in the bottom wall;

said inner wall having a neck;

said inner wall telescoped over said fill pipe, and absorbent material in the bottom of said receptacle to absorb spill fuel.

9. In combination with a gasoline tank fill pipe and spill well as defined in claim 8, wherein:

said receptacle is removable from said spill well and has means for closing both the necks formed by said outer wall and said inner wall whereby, after use, said absorbent material may be sealed within said receptacle for disposal thereof.

10. In combination with a gasoline tank fill pipe and spill well as defined in claim 8, and:

a spring collar in said neck to maintain said neck open.

11. In combination with a gasoline tank fill pipe and spill well as defined in claim 8, and:

said absorbent material covered with a fabric pad.

* * * * *